US007616164B2

(12) United States Patent
Krier et al.

(10) Patent No.: US 7,616,164 B2
(45) Date of Patent: Nov. 10, 2009

(54) OPTIMIZED CAPACITIVE DIPOLE ANTENNA

(75) Inventors: Mark Krier, Fountain Valley, CA (US); Shane Thornwall, San Diego, CA (US); Sebastian Rowson, San Diego, CA (US); Laurent Desclos, San Diego, CA (US)

(73) Assignee: ETHERTRONICS, Inc., San Diego, CA (US)

( * ) Notice: Subject to any disclaimer, the term of this patent is extended or adjusted under 35 U.S.C. 154(b) by 683 days.

(21) Appl. No.: 10/643,102

(22) Filed: Aug. 18, 2003

(65) Prior Publication Data

US 2004/0169613 A1 Sep. 2, 2004

(51) Int. Cl.
*H01Q 13/00* (2006.01)
*H01Q 1/38* (2006.01)

(52) U.S. Cl. ..... 343/783; 343/700 MS

(58) Field of Classification Search ..... 343/702, 343/793, 803, 821

See application file for complete search history.

(56) References Cited

U.S. PATENT DOCUMENTS

| | | | | |
|---|---|---|---|---|
| 3,725,940 | A | 4/1973 | Siple | |
| 6,204,817 | B1 * | 3/2001 | Edvardsson | 343/702 |
| 6,281,854 | B1 * | 8/2001 | Ohoka et al. | 343/767 |
| 6,424,300 | B1 * | 7/2002 | Sanford et al. | 343/702 |
| 6,515,630 | B2 * | 2/2003 | Honda | 343/702 |
| 6,549,169 | B1 * | 4/2003 | Matsuyoshi et al. | 343/702 |
| 6,597,318 | B1 * | 7/2003 | Parsche et al. | 343/700 MS |
| 6,674,409 | B2 | 1/2004 | Cheah | |
| 7,038,635 | B2 * | 5/2006 | Fukushima et al. | 343/895 |
| 2004/0135726 | A1 * | 7/2004 | Shamir et al. | 343/700 MS |
| 2004/0169614 | A1 * | 9/2004 | Desclos et al. | 343/803 |

FOREIGN PATENT DOCUMENTS

| | | | | |
|---|---|---|---|---|
| GB | 2387486 | * 10/2003 | ..... | 343/700 MS |

* cited by examiner

*Primary Examiner*—Douglas W Owens
*Assistant Examiner*—Minh D A
(74) *Attorney, Agent, or Firm*—Coastal Patent, LLC; Joshua S.. Schoonover

(57) ABSTRACT

A capacitively coupled dipole antenna is coupled to a substrate such that a capacitative portion of the antenna spans a void in the substrate.

7 Claims, 7 Drawing Sheets

*Side-View*

OPTIMIZED CAPACITIVE DIPOLE ANTENNA

CROSS-REFERENCE TO RELATED APPLICATIONS

The present invention is related to and claims priority from commonly assigned U.S. application Ser. No. 10/375,423, filed Feb. 27, 2003, which is incorporated herein by reference.

FIELD OF THE INVENTION

The present invention relates generally to antennas used for wireless communications, and particularly to size reduction and performance improvement of capacitively loaded magnetic dipole antennas used in wireless communications devices.

BACKGROUND

Many present day applications require that antennas provide large bandwidth, efficiency and isolation in as small form factor as possible. In some previous applications, antennas have been utilized that are known by those skilled in the art as Planar Inverted F Antenna (PIFA) antennas. Typically, PIFA antennas for use in small devices have required that they have relatively broad bandwidth. One method of achieving broad bandwidth utilizes mounting PIFA antennas in a dielectric. Although bandwidth is typically increased by a dielectric, the dielectric material also reduces the efficiency of the PIFA antenna. For some applications the integral nature of the PIFA/dielectric combination makes it difficult to incorporate PIFA/dielectric antenna combinations in wireless communications devices that require ever decreasing form-factor/profiles. One such small low-form factor/low-profile wireless communications device is a wristwatch that utilizes Global Positioning System (GPS) technology. The present invention addresses the requirements of these as well as other small low-profile/low-form factor devices by providing an improved antenna design that provides increased bandwidth, and improved efficiency and isolation over that available previously.

SUMMARY OF THE INVENTION

The present invention includes a capacitively coupled dipole antenna coupled to a substrate such that a capacitative portion of the antenna spans a void in the substrate.

In one embodiment, a wireless device comprises a first portion; a second portion; a third portion, the third portion coupled to the first portion and to the second portion; and a substrate, the substrate comprising at least one void, wherein the first portion, the second portion, and the third portion define a capacitively coupled dipole antenna, and wherein the antenna is coupled to the substrate. The antenna may configured to operate at a frequency selected from a group that includes a GPS, a Bluetooth, a WiFi, and a cellular phone frequency.

In one embodiment, a dipole antenna comprises a first portion; a second portion, the first and second portion defining a capacitive area; a third portion, the third portion coupled to the first portion and to the second portion, the third portion defining an inductive area; and a substrate, the substrate defined by a periphery and a void within the periphery, wherein the first portion, the second portion, and the third portion define a capacitively coupled dipole antenna, and wherein the capacitively coupled dipole antenna is coupled to the substrate such that the capacitative area spans the void. The third portion may comprise a length having a first end and a second end, wherein the length is longer than a straight line distance between the first end and the second end. One or more portion of the third portion may be disposed relative to the first portion and the second portion in a non-parallel relationship. One or more portion of the third portion may be disposed relative to the first portion and the second portion in a parallel relationship. The antenna may comprise a high dissipation factor substrate, wherein at least the first and second portion are coupled to the high dissipation factor substrate. The substrate may comprise a FR4 substrate.

In one embodiment, a system comprises a capacitively coupled dipole antenna, the antenna including a capacitative area; and a substrate, the substrate comprising a first void, wherein the antenna is coupled to the substrate, and wherein the capacitative area generally spans the void. The substrate may comprise a high dissipation factor substrate. The substrate may comprise a FR4 substrate. The system may comprise a plurality of circuits. The antenna may be configured to operate at a frequency selected from a group that includes a GPS, a Bluetooth, a WiFi, and a cellular phone frequency. The substrate may comprise a second void, wherein at least one of the plurality of circuits is disposed within the second void. The system may comprise a wrist type apparatus. The system may comprise a medallion, a button, a belt buckle, a wrist type of apparatus, a phone, a PDA.

In one embodiment, a capacitively coupled dipole antenna may comprise capacitance means for creating a capacitance; and inductive means for creating an inductance. The antenna may further comprise a substrate. The substrate may be defined by a periphery, wherein within the periphery the substrate defines a void, and wherein the capacitance generally spans the void.

In one embodiment, a method for creating resonance in a resonant circuit comprises the steps of providing a first portion; providing a second portion; disposing the first and second portion to create a capacitive area; and coupling the third portion to the first portion and to the second portion to create an inductive area. The method may further comprise the step of providing a substrate, wherein the substrate is defined by a periphery, wherein within the periphery the substrate defines a void, and wherein the capacitive area generally spans the void.

In one embodiment, a system comprises a plurality of antennas, wherein at least two of the antennas each defines a capacitative area; and a substrate, the substrate comprising a plurality of voids, wherein the capacitative area of the at least two antennas generally spans respective ones of the plurality of voids. The system may comprise a wrist type of apparatus. The at least two of the antennas may comprise capacitively coupled dipole antennas.

Other embodiments and other features will become apparent by referring to the Description and the Claims that follow.

DETAILED DESCRIPTION OF THE INVENTION

In the following description, for purposes of explanation and not limitation, specific details are set forth in order to provide a thorough understanding of the present invention. However, it will be apparent to those skilled in the art that the present invention may be practiced in other embodiments that depart from these specific details. In other instances, detailed descriptions of well-known methods and devices are omitted so as to not obscure the description of the present invention with unnecessary detail.

Figure 1A:
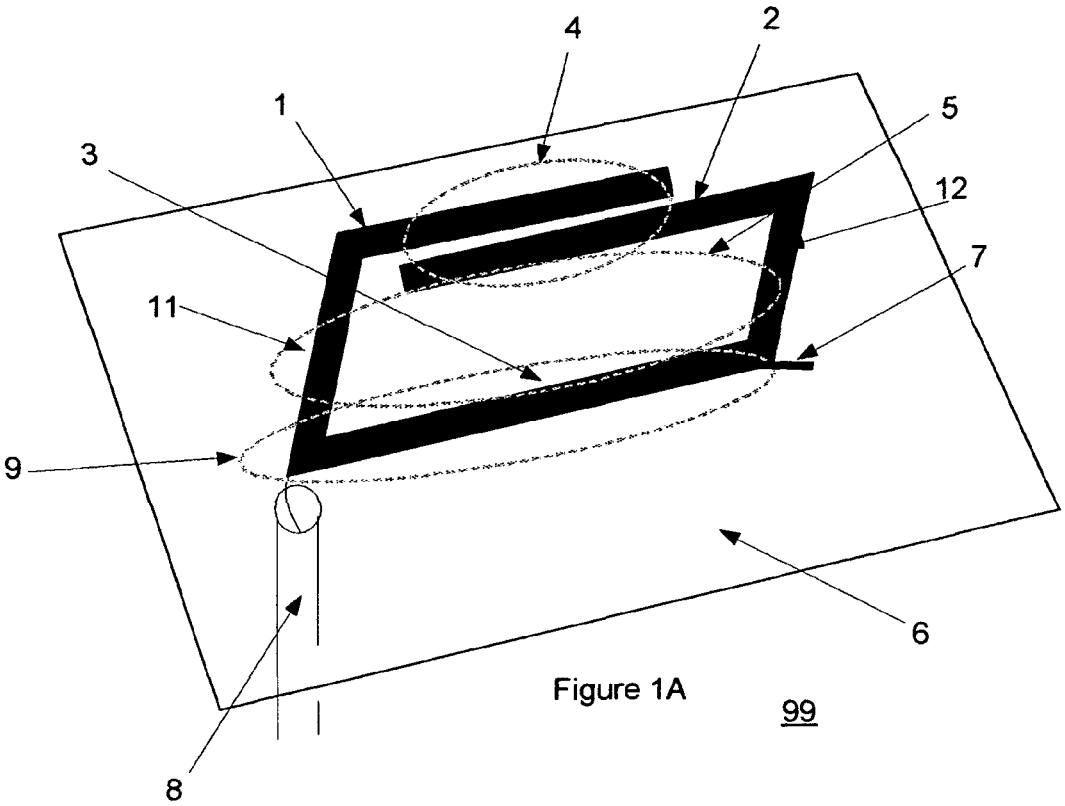
FIGS. 1*a-b* illustrate a respective three-dimensional and side-view of a capacitively loaded dipole antenna.
Figure 1B:
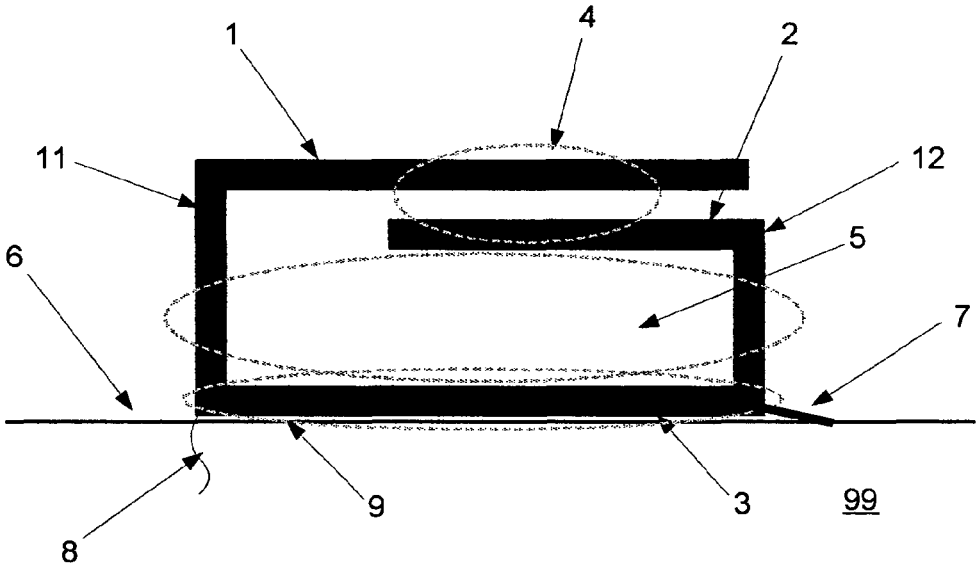

FIGS. 1*a-b* illustrate respective three-dimensional and side views of a capacitively loaded magnetic dipole antenna (99). In one embodiment, antenna (99) comprises a first (1), a second (2), and a third (3) portion. In one embodiment, the first portion (1) is coupled to the third portion (3) by a first coupling portion (11), and the third portion (3) is coupled to the second portion (2) by a second coupling portion (12). In one embodiment, antenna (99) comprises a feed area, generally indicated as feed area (9), where input or output signals are provided by a feedline (8) that is coupled to the third portion (3). In one embodiment, the first coupling portion (11) and the second coupling portion (12) are disposed relative to each other in a generally parallel relationship. In one embodiment, first portion (1), second portion (2), and third portion (3) are disposed relative to each other in a generally parallel relationship. In one embodiment, first portion (1), second portion (2), and third portion (3) are disposed relative to each other in a generally coplanar relationship. In one embodiment, the portions (1), (2), and (3) are generally orthogonal to portions (11) and (12). In one embodiment, one or more of portions (1), (2), (3), (11), (12) are disposed in a generally orthogonal or parallel relationship relative to a ground (6) portion. It is understood, however, that the present invention is not limited to the described embodiments, as in other embodiments portions (1), (2), (3), (11), (12) may be disposed relative to each other and/or ground (6) in other geometrical relationships and with other geometries. For example, first portion (1) may be coupled to third portion (3), and third portion (3) may be coupled to second portion (2) such that one or more of the portions are disposed relative to each other in non-parallel, non-orthogonal, and/or non-coplanar relationships. In one embodiment, portions (1), (2), (3), (11), and (12) may comprise electrical conductors. The conductors may be shaped to comprise one or more geometry, for example, cylindrical, square, rectangular, planar, etc., or other geometries known to those skilled in the art. The conductors may be flexible, rigid, etc., or combination thereof.

In one embodiment, third portion (3) is disposed above a ground (6). In one embodiment, third portion (3) is disposed coplanarly with a ground (6). In one embodiment, ground (6) comprises a ground plane. In one embodiment, third portion (3) is electrically isolated from ground (6), other than where third portion (3) is coupled to ground (6) at a grounding point (7).

It is also identified that antenna (99) may be modeled as a radiative resonant LC circuit with a capacitance (C) that corresponds to a fringing capacitance that exists across a first void that is bounded generally by first portion (1) and second portion (2), and which is indicated generally as capacitive area (4); and with an inductance (L) that corresponds to an inductance that exists in a second void that is bounded generally by the second portion (2) and third portion (3), and which is indicated generally as inductive area (5).

It is further identified that the geometrical relationship between portions (1), (2), (3), (11), (12), and the gaps formed thereby, may be used to effectuate an operating frequency about which the antenna (99) resonates to radiate or receive a signal.

Figure 1C:
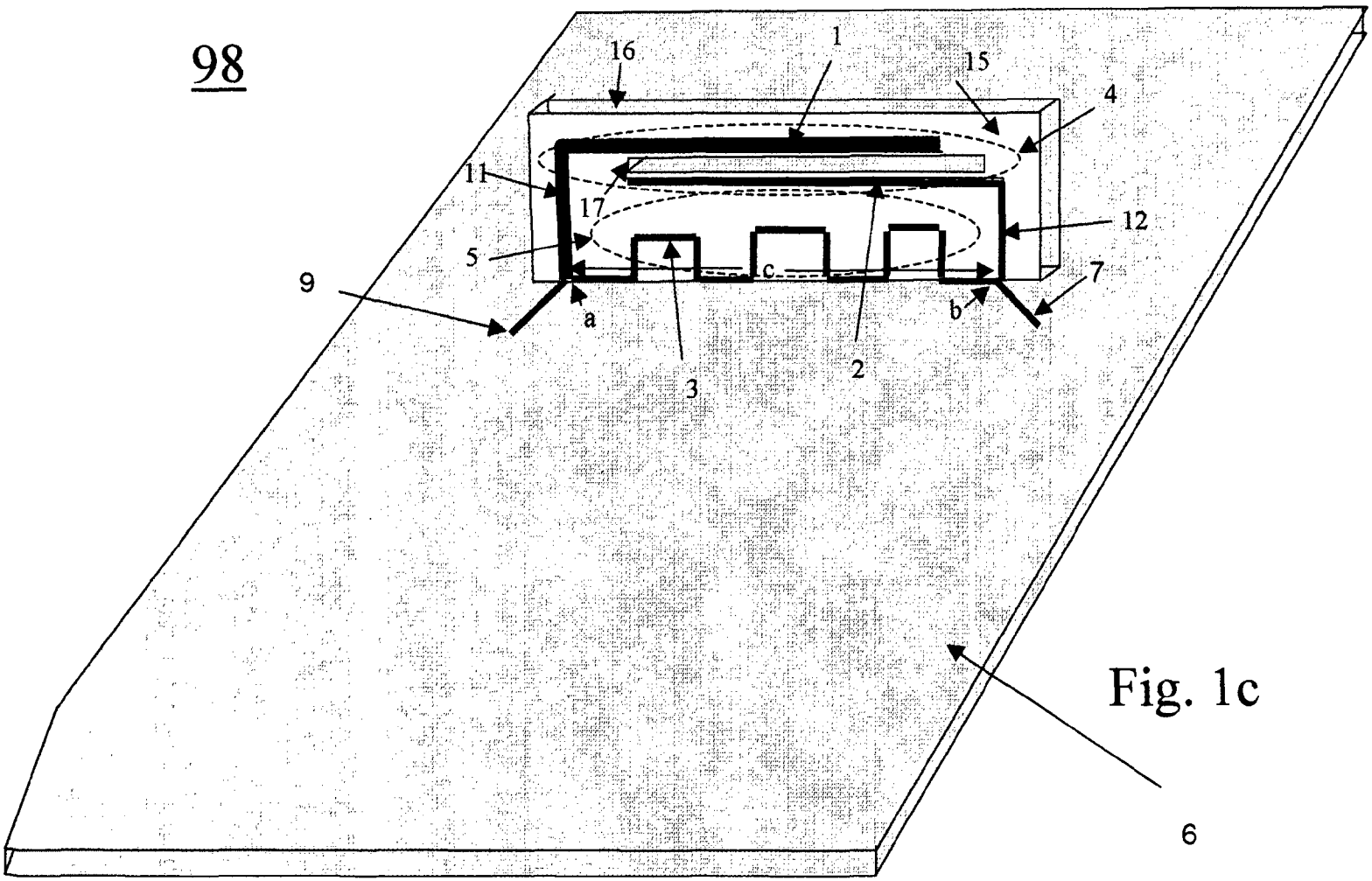
FIG. 1*c* illustrates a three dimensional view of a low profile/small form factor capacitively loaded dipole antenna.

FIG. 1*c* illustrates a three-dimensional view of a capacitively loaded magnetic dipole antenna (98). Some aspects of antenna (98) are similar to embodiments of antenna (99) described previously above and may be understood by those skilled in the art by referring to the description of antenna (99). However, it is identified that at least one aspect of antenna (98) differs from that of antenna (99). For example, in one embodiment, third portion (3) is defined by a length that is longer than a straight-line distance (c) between a first end (a) and a second end (b) of the third portion. In the illustrated embodiment, third portion (3) includes linear portions that are coupled in alternating orthogonal orientations. In one embodiment, the linear portions are disposed in generally parallel and/or orthogonal relationships relative to a ground (6). In one embodiment, ground (6) comprises a grounding plane. In other embodiments, it is identified that third portion (3) may include one or more portion that comprises or is coupled to comprise other geometries, for example, a linear geometry, a curved geometry, a combination thereof, etc.

In one embodiment, portion (1), portion (2), and portion (3) are coupled to a substrate (15). In one embodiment substrate (15) comprises a high dissipation factor substrate, for example, a FR4 substrate known to those skilled in the art. In one embodiment, substrate (15) is defined by an outer periphery (16) and by an inner periphery (17). In one embodiment, the inner periphery defines a void within the substrate. In one embodiment, the capacitive area (4) generally spans the void.

It is identified that by coupling the first portion (1) and second portion (2) to a high dissipation factor substrate (15) such that the capacitive area (4) spans a void in the substrate, the capacitance of antenna (98) may be increased over that of the capacitance of antenna (99). As compared to a capacitance of the antenna (99), an antenna (98) that has an equivalent capacitance may be thus provided to comprise a smaller form-factor/profile.

It is also identified that by providing a third portion (3) that comprises a length that is longer than a straight line distance (c) between the first end (a) and the second end (b) of the third portion, the antenna (98) inductance in the inductive area (5) may be increased over that of the inductance of the antenna (99). As compared to an inductance of antenna (99), an antenna (98) that has an equivalent inductance may be thus provided to comprise a smaller form-factor/profile.

Figure 2A:
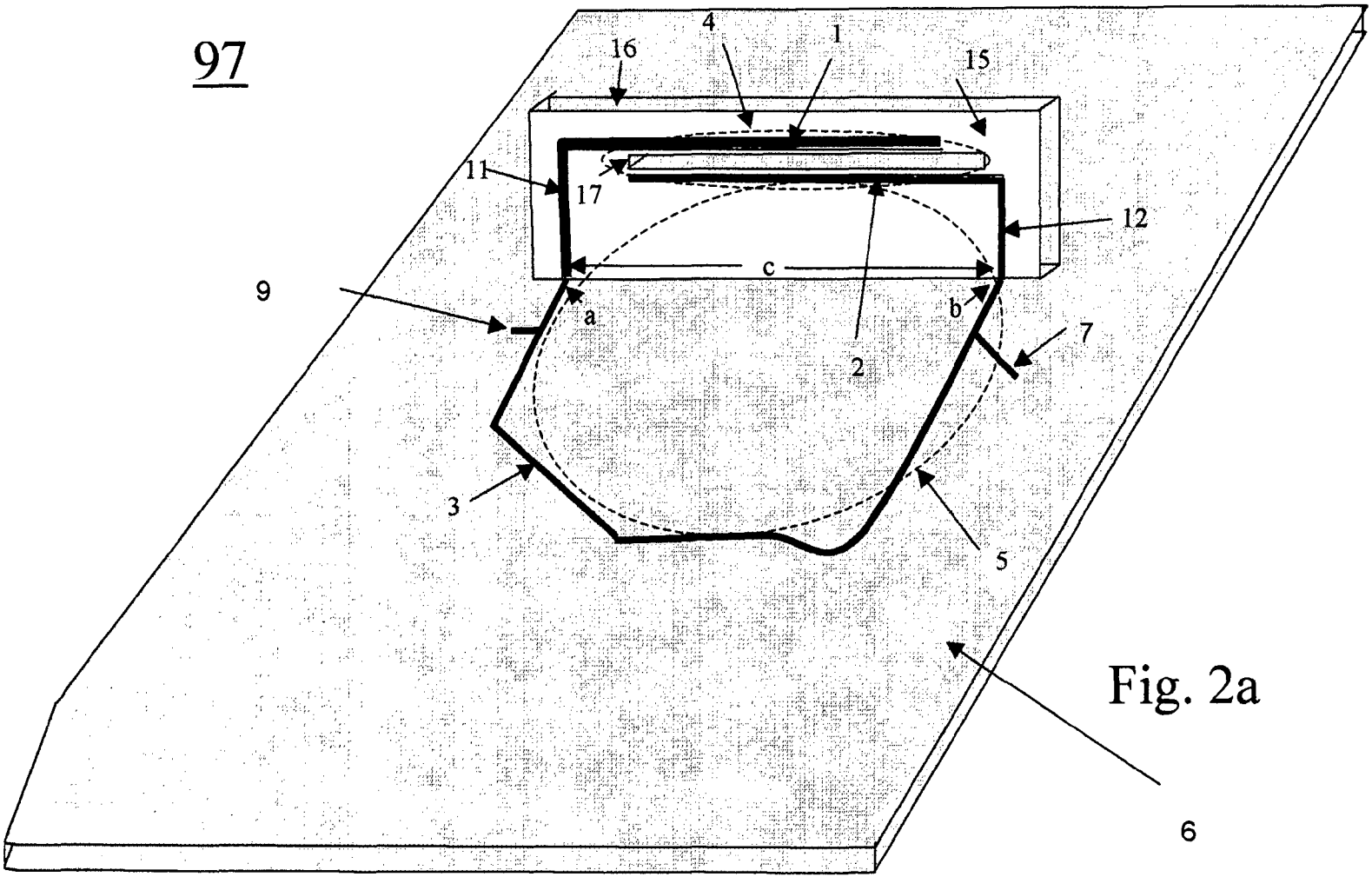
FIG. 2*a* illustrates a three dimensional view of a low profile/small form factor capacitively loaded dipole antenna.

FIG. 2*a* illustrates a three-dimensional view of a capacitively loaded magnetic dipole antenna (97). In one embodiment, antenna (97) comprises a first (1), a second (2), and a third (3) portion. In one embodiment, the first portion (1) is coupled to the third portion (3) by a first coupling portion (11), and the third portion (3) is coupled to second portion (2) by a second coupling portion (12). In one embodiment, antenna (98) comprises a feedline (8) that is coupled to the third portion (3), where input or output signals are provided. It is identified that antenna (97) may be modeled as a radiative resonant LC circuit with a capacitance (C) that corresponds to a fringing capacitance that exists in a capacitive area (4) that is bounded generally by first portion (1) and second portion (2); and with an inductance (L) that corresponds to an inductance that exists in an inductive area (5) that is bounded generally by the second portion (2) and the third portion (3).

Some aspects of antenna (97) are similar to embodiments of antenna (98) described previously above and may be understood by those skilled in the art by referring to the description of antenna (99). However, it is identified that at least one aspect of antenna (97) differs from that of antenna (99). For example, in one embodiment, third portion (3) is defined by a length that is longer than a straight-line distance (c) between a first end (a) and a second end (b) of the third portion. FIG. 2*a* also illustrates an embodiment of antenna (98) wherein third portion (3) is disposed in a generally non-coplanar relationship relative to a generally coplanar relationship of the first portion (1) and second portion (2). In one embodiment, third portion (3) may be disposed in a plane that is generally coplanar with, or above, a ground (6). In one embodiment, third portion (3) may be electrically isolated from the ground (6), other than where third portion (3) is coupled to ground (6) at a grounding point (7). It is identified that third portion (3) may include one or more portion that comprises or is coupled to comprise other geometries, for example, a linear geometry, a curved geometry, etc., a combination thereof.

In one embodiment, the ground (6) and/or one or more portion of third portion (3) may be disposed in a plane that is generally orthogonal to a coplanar relationship of the first portion (1) and the second portion (2). In one embodiment (not illustrated), the ground (6) and/or one or more portion of third portion (3) may be disposed in a plane that is in a generally angular relationship relative to a substrate (15), which first portion (1) and second portion (2) are coupled to. In one embodiment, the angular relationship may be between 0 and 180 degrees. In one embodiment, substrate (15) comprises a high dissipation factor substrate, for example, a FR4 substrate. In one embodiment, substrate (15) is defined by an outer periphery (16) and by an inner periphery (17). In one embodiment, the inner periphery defines a void within the substrate. In one embodiment, the capacitive area (4) spans the void.

It is identified that by coupling the first portion (1) and second portion (2) to a high dissipation factor substrate (15) such that the capacitive area (4) spans a void in the substrate, the capacitance of antenna (97) may be increased over that of the capacitance of antenna (99).

It is also identified that by providing a third portion (3) that comprises a length that is longer than a straight line distance (c) between the first end (a) and the second end (b) of the third portion, the antenna (97) inductance in the inductive area (5) may be increased over that of the inductance of antenna (99).

Figure 3A:
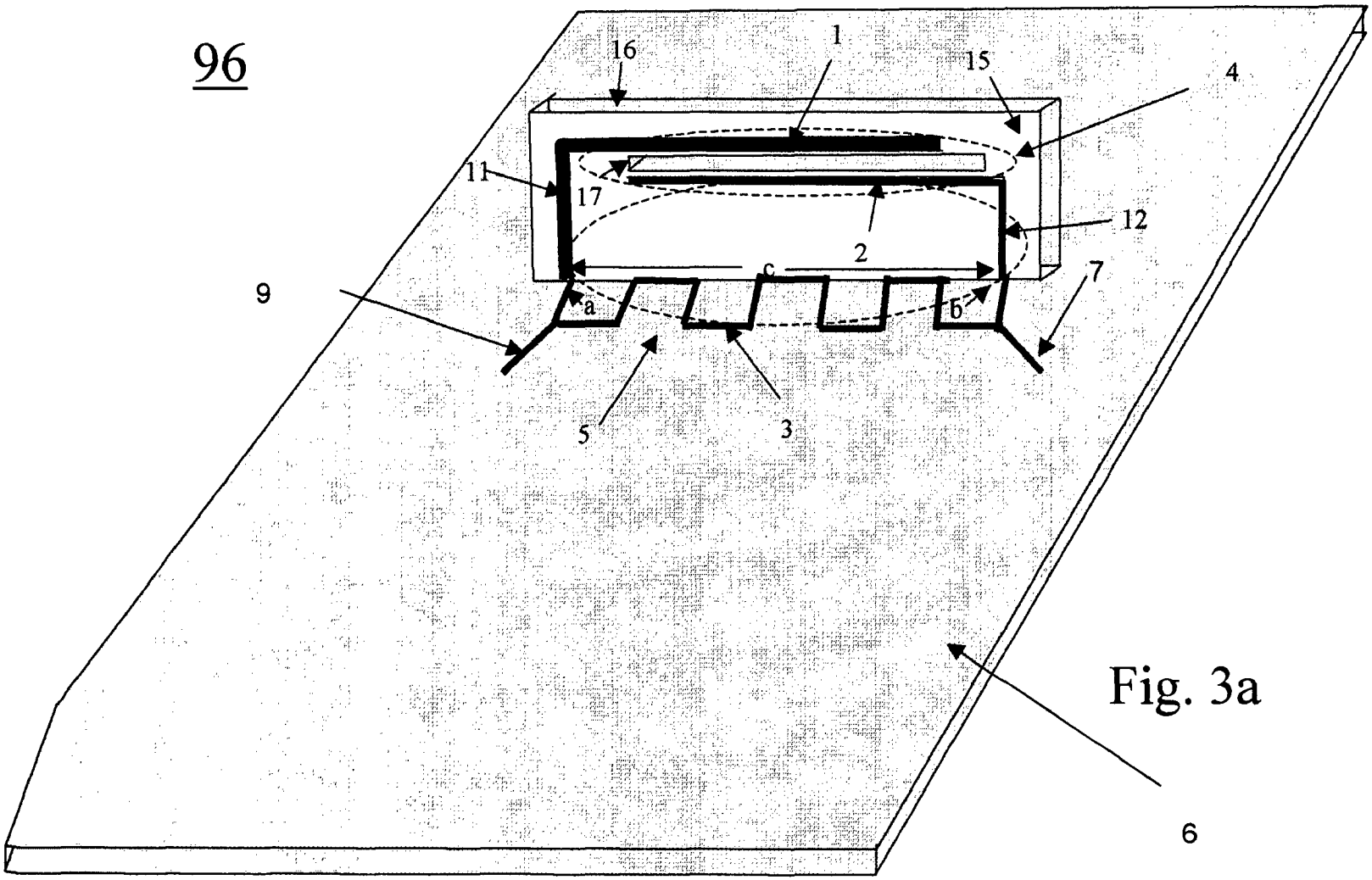
FIGS. 3*a-b* illustrate three dimensional views of a tow profile/small form factor capacitively loaded dipole antenna.
Figure 3B:
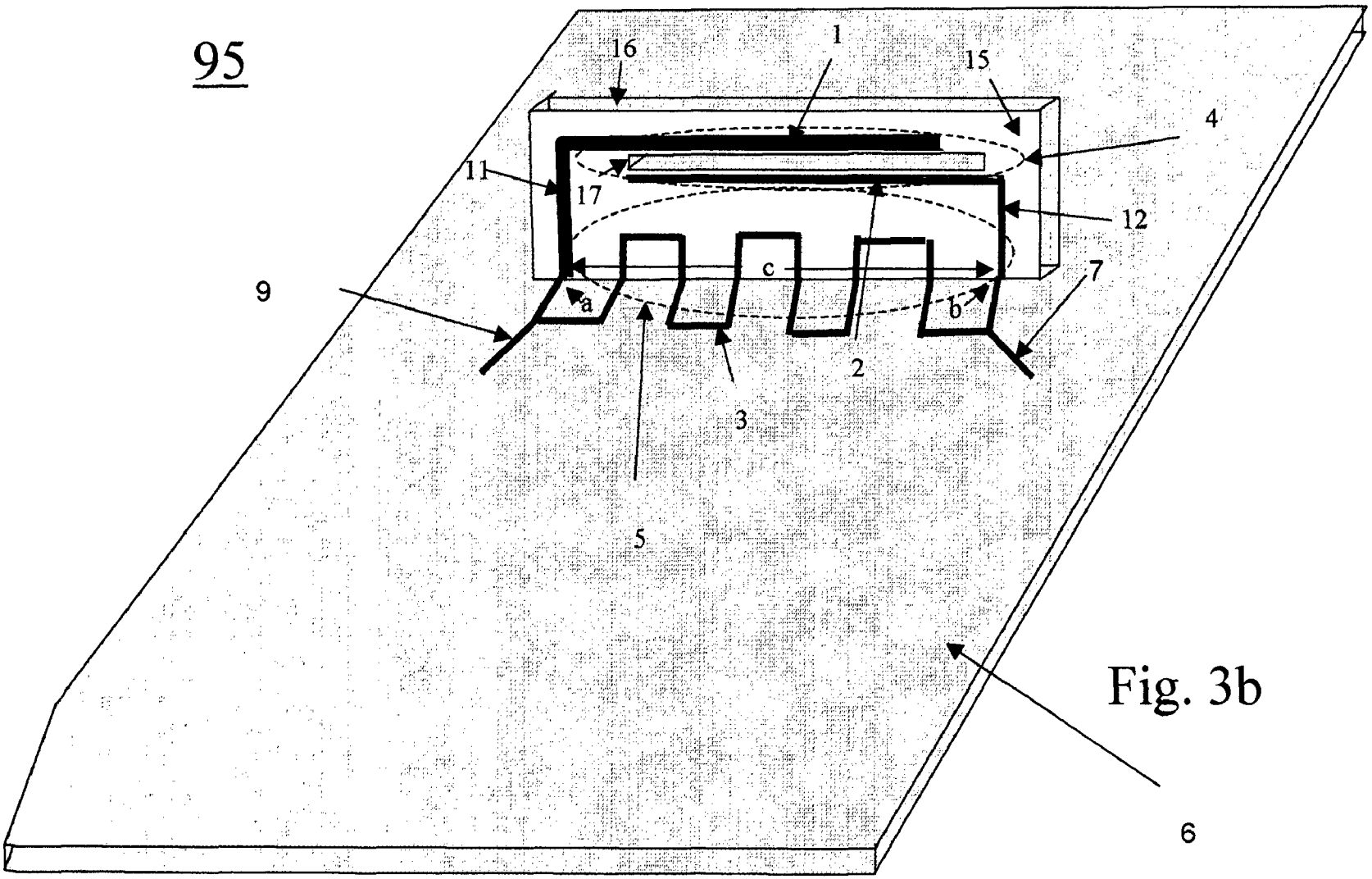

FIGS. 3*a-b* illustrate three-dimensional views of a capacitively loaded magnetic dipole antenna (96) and (95). In one embodiment, the first portion (1) is coupled to the third portion (3) by a first coupling portion (11), and the third portion (3) is coupled to second portion (2) by a second coupling portion (12). In one embodiment, antenna (96) comprises a feedline (8) that is coupled to the third portion (3) and where input or output signals are provided.

Some aspects of antenna (96) and (95) are similar to embodiments of antennas (97-99) described previously above and may be understood by those skilled in the art by referring to the description of antennas (97-99). However, it is identified that at least one aspect of antenna (96) and (95) differs from that of antennas (97-99). For example, in one embodiment, third portion (3) is defined by a length that is longer than a straight-line distance (c) between a first end (a) and a second end (b) of the third portion. FIGS. 3*a* and 3*b* also illustrate embodiments wherein at least one portion of the third portion (3) is disposed in a generally non-coplanar relationship relative to a generally coplanar relationship of the first portion (1) and second portion (2). FIG. 3*b* illustrates one embodiment where, additionally, at least one portion of the third portion (3) is disposed in a generally coplanar relationship relative to the generally coplanar relationship of the first portion (1) and second portion (2). It is identified that third portion (3) may include one or more portion that comprises or is coupled to comprise other geometries, for example, a linear geometry, a curved geometry, etc., a combination thereof.

FIGS. 3*a-b* also illustrate embodiments wherein at least one portion of third portion (3) may be disposed in a plane that is generally coplanar with, or above, a ground (6). In one embodiment, third portion 93) is electrically isolated from the ground (6), other than where third portion (3) is coupled to ground (6) at a grounding point (7).

In one embodiment (not illustrated), ground (6) and/or at least one portion of third portion (3) may be disposed in a plane that is in an angular relationship relative to the substrate (15). In one embodiment, the angular relationship may be between 0 and 180 degrees.

In one embodiment substrate (15) comprises a high dissipation factor substrate, for example, a FR4 substrate. In one embodiment, substrate (15) is defined by an outer periphery (16) and by an inner periphery (17), and the inner periphery defines a void within the substrate. In one embodiment, the capacitive area (4) generally spans the void.

It is identified that by coupling the first portion (1) and second portion (2) to a high dissipation factor substrate (15) such that the capacitive area spans a void in the substrate, the capacitance of antennas (96) and (95) may be increased over that of the capacitance of antenna (99). As compared to a capacitance of antenna (99), an antenna (96) and (95) that has an equivalent capacitance may be thus provided to comprise a lower form-factor/profile.

It is also identified that by providing a third portion (3) that comprises a length that is longer than a straight line distance (c) between the first end (a) and the second end (b) of the third portion, the inductance of antennas (96) and (95) in the inductive area (5) may be increased over that of the inductance of antenna (99). As compared to an inductance of antenna (99), antennas (96) and (95) that have an equivalent inductance may be thus provided to comprise a lower form-factor/profile.

Figure 4:
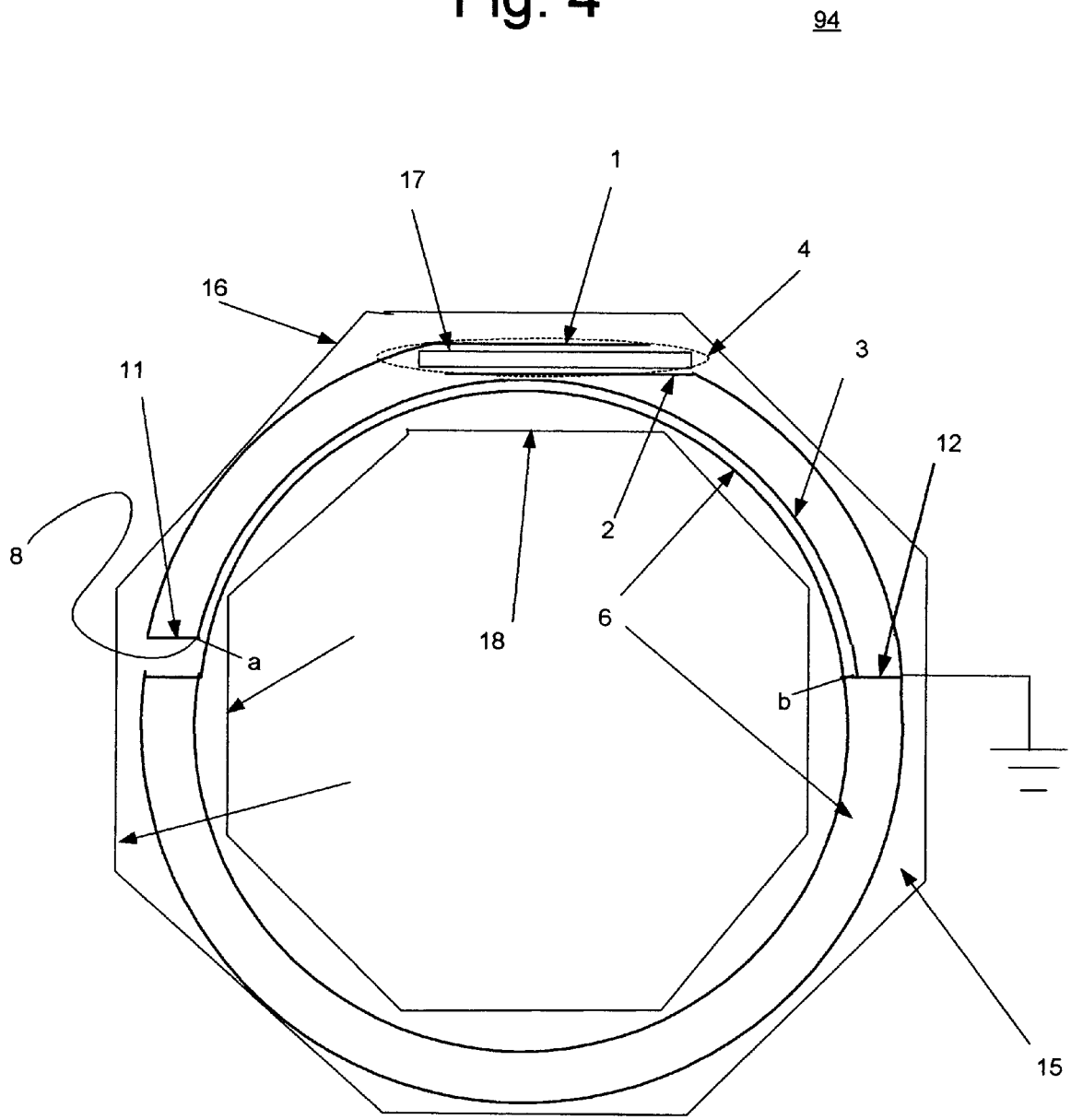
FIG. 4 illustrates a front view of a low profile/small form factor capacitively loaded dipole antenna.

FIG. 4 illustrates a front view of a capacitively loaded magnetic dipole antenna (94). In one embodiment, antenna (94) comprises a first (1), a second (2), and a third (3) portion. In one embodiment, the first portion (1) is coupled to the third portion (3) by a first coupling portion (11), and the third portion (3) is coupled to second portion (2) by a second coupling portion (12). It is understood that coupling portions (11) and (12) may not be needed when the geometry of first (1), second (2) and third (3) portions may be used to effectuate a coupling function. In one embodiment, antenna (94) comprises a feedline (8) coupled at a feedpoint to third portion (3) where input or output signals are provided. It is identified that antenna (94) may be modeled as a radiative resonant LC circuit with a capacitance (C) that corresponds to a fringing capacitance that exists in a capacitive area (4) that is bounded generally by portions of first portion (1) and second portion (2); and with an inductance (L) that corresponds to an inductance that exists in an inductive area that is located generally between portions of second portion (2) and third portion (3).

Some aspects of antenna (94) are similar to embodiments of other antennas described previously above and may be understood by those skilled in the art by referring to the above Description. However, it is identified that certain aspects of antenna (94) differ from that of some of the antennas already described. For example, in one embodiment, third portion (3) is defined by a length that is longer than a straight-line distance between a first end (a) and a second end (b) of the third portion. FIG. 4 also illustrates an embodiment of antenna (94) wherein third portion (3) is disposed in a generally coplanar relationship relative to a generally coplanar relationship of the first portion (1) and second portion (2). In one embodiment, third portion (3) may be disposed in a plane that is generally coplanar with, or above, a ground (6) portion. In one embodiment, third portion (3) may be electrically isolated from the ground (6), other than where third portion (3) is coupled to ground (6) at a grounding point (7). In one embodiment, the ground (6) and/or one or more of portions (1), (2), (3), (11), (12) may be disposed in planes that are generally non-coplanar relative to each other. Although shown to comprise the illustrated geometries, it is identified that portions (1), (2), (3), (6), (11), (12) may be shaped such that one or more portion is comprised of and/or is coupled to comprise other geometries, for example, a linear geometry, a semi-curved geometry, etc., or combinations thereof.

In one embodiment, one or more of portions (1), (2), (3), (6), (11), (12) are coupled to a substrate (15). In one embodiment, substrate (15) comprises a high dissipation factor substrate, for example, a FR4 substrate. In one embodiment, substrate (15) is defined by an outer periphery (16) and by an inner periphery (17). In one embodiment, the inner periphery (17) defines a void within substrate (15). In one embodiment, the capacitive area (4) spans one or more portion of the void defined by periphery (17).

It is identified that by coupling the first portion (1) and second portion (2) to a high dissipation factor substrate (15) such that the capacitive area (4) spans a void in the substrate, the capacitance of antenna (94) may be increased over that of an antenna lacking such a void. As compared to an antenna (99), an antenna (94) that has an equivalent capacitance may be thus provided to comprise a smaller form-factor/profile. Furthermore, by providing an antenna geometry that allows removal of dielectric material from a capacitative area of the antenna (94), the efficiency of the antenna design may be increased, for example, over that of a PIFA antenna design operating at the same frequency.

It is also identified that by providing a third portion (3) that comprises a length that is longer than a straight line distance (c) between the first end (a) and the second end (b) of the third portion, the antenna (94) inductance in the inductive area (5) may be increased. As compared to an antenna (99), an antenna (94) that has an equivalent inductance may be thus provided to comprise a smaller form-factor/profile.

As is seen in FIG. 4, the curved geometry of third portion (3) and/or other portions of antenna (94) allows the antenna to be utilized in many useful applications not previously attainable. For example, in one embodiment, the antenna (94) designs allows that it be coupled to a substrate (15) that comprises more than one inner periphery, for example, inner periphery (18). Such an inner periphery (18) may also be used to define a second void within substrate (15), which can be used not only to reduce the amount of dielectric to which antenna (94) is coupled to, and thus increase antenna efficiency, but also provide an area in which a device, circuit, and/or other apparatus may be placed. In one embodiment, antenna (94) is coupled for use in a wrist type device configured to receive Global Positioning Signals (GPS) signals, for example, signals in the 1.575 GHz range. In one embodiment, the wrist type of apparatus comprises a wrist watch. An antenna (94) used in such an application enables users to determine their position with great accuracy without the need for the relatively bulky and heavy wrist type apparatus of the prior art. Other frequencies at which antenna (94) operates are also considered to be within the scope of the present invention. For example, frequencies such as other GPS frequencies, Bluetooth frequencies, WiFi frequencies, etc. Other devices, circuits, and apparatus are also considered to be within the scope of the present invention. For example, small medallions for wear around the neck or other body parts, buttons, belt buckles, and other applications where a reduction and size would provide enhanced enjoyment.

Figure 5:
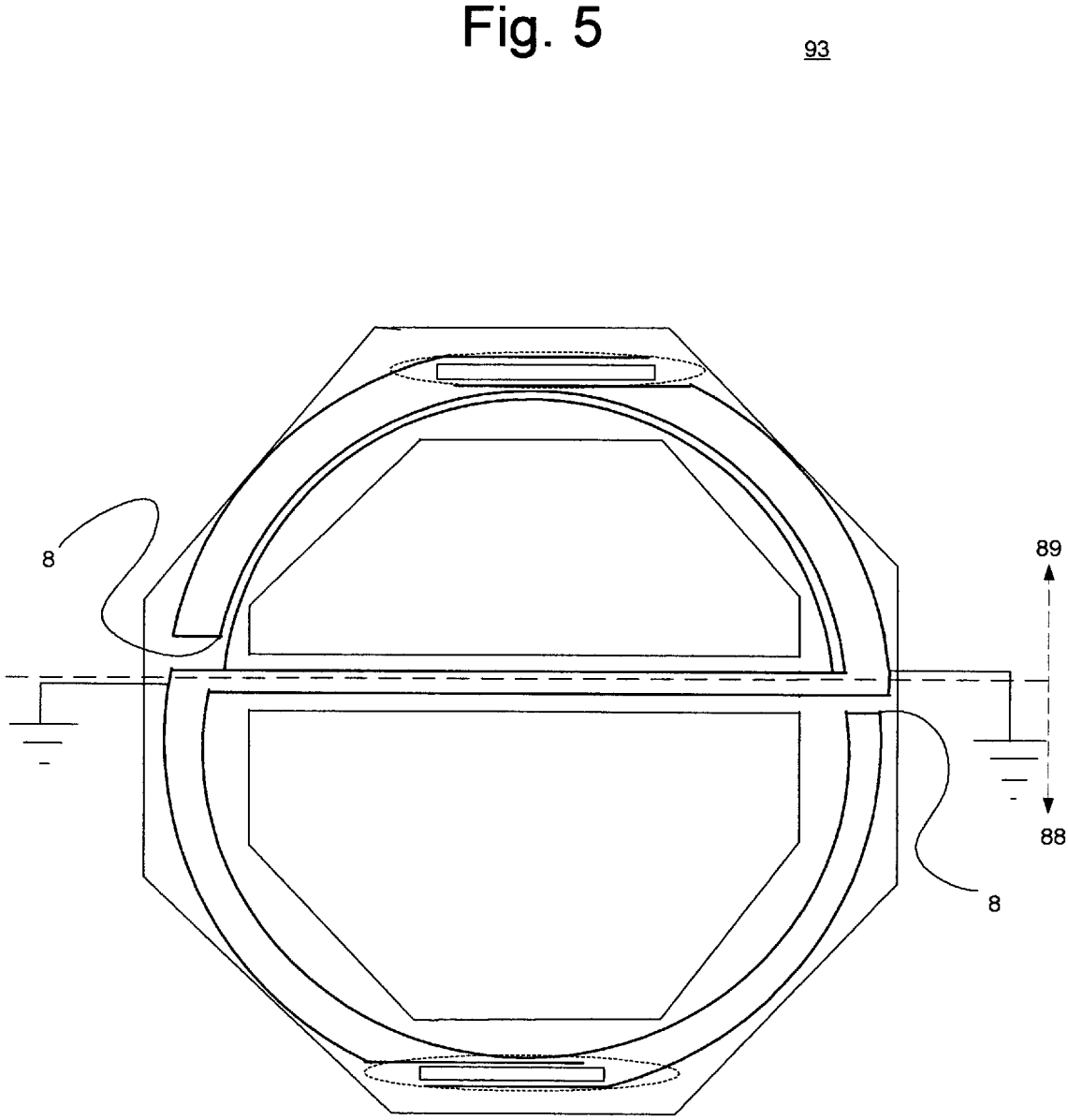
FIG. 5 illustrates a front view of two low profile/small form factor capacitively loaded dipole antennas coupled back to back.

FIG. 5 illustrates an embodiment of two capacitively loaded magnetic dipole antennas (93) coupled back to back. Some aspects of antenna (93) are similar to the embodiments of FIG. 4 described, however, it is identified that certain aspects of antenna (93) differ from that of the antenna (94). For example, antenna (93) comprises two capacitively loaded magnetic dipole antenna sections (88) and (89) coupled in a back to back type configuration. For purposes of clarity of the FIG. 5, the portions comprising sections (88) and (89) are not specifically identified, however, those skilled in the art will understand the functionality provided by each portion of each section by referring to the description of the Figures above. With appropriate changes in antenna geometry, each antenna section (88) and/or (89) may be configured to receive or send signals at different frequencies. For example, in one embodiment, it is envisioned that section (88) of antenna (93) could operate at Bluetooth frequencies, and section (89) could operate at GPS frequencies. Other combinations of frequencies are also contemplated.

Although described in embodiments that include wrist watches, medallions, buttons, etc., it is understood that the embodiments described herein may also find applicability in other wireless communication systems and devices, and circuits thereof, operating in one or more of frequency bands, for example, systems and devices such as PDA's, cell phones, etc.

Thus, it will be recognized that the preceding description embodies one or more invention that may be practiced in other specific forms without departing from the spirit and essential characteristics of the disclosure and that the invention is not to be limited by the discussed and illustrated details, but rather is to be defined by the appended claims.

What is claimed:

1. A system, comprising:

a capacitively coupled dipole antenna, the antenna including a capacitative area;

a substrate, the substrate comprising a first void, wherein the antenna is coupled to the substrate, and wherein the capacitative area generally spans the void;

wherein the system comprises a plurality of circuits, and wherein the substrate comprises a second void, wherein at least one of the plurality of circuits is disposed within the second void.

2. The system of claim 1, wherein the substrate comprises a high dissipation factor substrate.

3. The system of claim 1, wherein the substrate comprises a FR4 substrate.

4. The system of claim 1, wherein the antenna is configured to operate at a frequency selected from the group consisting of: a GPS, a Bluetooth, a WiFi, a cellular phone frequency.

5. The system of claim 1, wherein the system comprises a wrist type apparatus.

6. The system of claim 1, wherein the system is selected from a group consisting of: a medallion, a button, a belt buckle, a wrist, a phone, a PDA apparatus.

7. The system of claim 1, wherein the system comprises a wrist type apparatus.

* * * * *